US012747572B1

(12) United States Patent
Waid, IV

(10) Patent No.: US 12,747,572 B1
(45) Date of Patent: Sep. 29, 2026

(54) INTERACTIVE GAMING URINAL

(71) Applicant: Charlie Robert Waid, IV, Houston, TX (US)

(72) Inventor: Charlie Robert Waid, IV, Houston, TX (US)

( * ) Notice: Subject to any disclaimer, the term of this patent is extended or adjusted under 35 U.S.C. 154(b) by 0 days.

(21) Appl. No.: 19/544,406

(22) Filed: Feb. 19, 2026

(51) Int. Cl.
*E03D 13/00* (2006.01)
*A63F 9/00* (2006.01)
*A63F 9/24* (2006.01)

(52) U.S. Cl.
CPC ..... *E03D 13/005* (2013.01); *A63F 9/001* (2013.01); *A63F 9/24* (2013.01); *A63F 2009/0049* (2013.01); *A63F 2009/2402* (2013.01); *A63F 2009/2442* (2013.01); *A63F 2300/5533* (2013.01)

(58) Field of Classification Search
CPC ..... E03D 13/005; A63F 9/001; A63F 9/24; A63F 2009/0049; A63F 2009/2402; A63F 2009/2442; A63F 2300/5533
See application file for complete search history.

(56) References Cited

U.S. PATENT DOCUMENTS

| | | | | |
|---|---|---|---|---|
| 6,385,796 | B1 * | 5/2002 | Muir, Jr. | E03D 13/00 4/304 |
| 6,477,718 | B1 | 11/2002 | Wang et al. | |
| 6,513,173 | B1 | 2/2003 | Sykes | |
| 7,194,776 | B1 | 3/2007 | Lastuka et al. | |
| 7,798,907 | B2 | 9/2010 | Piccionelli et al. | |
| 9,550,115 | B2 | 1/2017 | Silva | |
| 10,604,924 | B2 | 3/2020 | Staton et al. | |
| 11,443,597 | B2 | 9/2022 | McCoy | |
| 2008/0088645 | A1 * | 4/2008 | Akifusa | A63F 13/45 345/473 |
| 2011/0050432 | A1 | 3/2011 | MacSween et al. | |
| 2013/0016197 | A1 * | 1/2013 | Koo | E03D 13/005 348/61 |
| 2021/0383653 | A1 * | 12/2021 | McCoy | G07F 17/3206 |
| 2024/0044681 | A1 * | 2/2024 | Deutch | A63B 67/00 |

* cited by examiner

*Primary Examiner* — Jeremy Carroll
(74) *Attorney, Agent, or Firm* — NK Patent Law

(57) ABSTRACT

A gaming urinal including a play screen within the body of the urinal. The play screen includes a cover over a display and a force detection layer sensitive enough to detect the force a urine stream on the front of the play screen, thereby providing a sort of touch screen where the touch is a urine stream. The play screen provides the ability to play a variety of different games, including but not limited to shape tracing games and target practice games.

20 Claims, 11 Drawing Sheets

| |
|---|
| 200 |
| 202 |
| 204 |
| 206 |
| 210 |
| 212 |

FIG. 3

INTERACTIVE GAMING URINAL

TECHNICAL FIELD

The field of the invention relates generally to urinals. More specifically, the field of the invention relates to urinals providing interactive gaming experiences.

BACKGROUND

Smart urinals have been proposed that incorporate gaming elements. Generally, smart urinals are designed with the purpose of analyzing health information of urine, such as glucose levels, alcohol content, or hydration. In some cases, gamification elements have been introduced to try to incentivize and facilitate the collection of such health information. However, those gamification elements have previously been secondary to the primary purpose of collecting health information and therefore the gamification has been very limited. What is needed is a gaming urinal, with the primary purpose of providing a fun and interactive experience while peeing.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the invention is directed to a gaming urinal, including a urinal body, including a back wall and a lower bowl, wherein the lower bowl includes a drain, a play screen extending outwardly from the back wall of the urinal body, the play screen including a transparent cover, a display panel, and a force detection layer, wherein the force detection layer is configured to detect a location of force applied by a urine stream on the front of the play screen, and wherein the display panel interactively changes what is displayed based on where the force is detected by the force detection layer.

In another embodiment, the invention is directed to a gaming urinal, including a urinal body, including a back wall and a lower bowl, wherein the lower bowl includes a drain, a play screen extending outwardly from the back wall of the urinal body, the play screen including a display panel and a force detection layer, wherein the force detection layer is configured to detect a location of force applied by a urine stream on the front of the play screen, wherein the display panel interactively changes what is displayed based on where the force is detected by the force detection layer, and wherein the gaming urinal is configured to communicate with at least one other gaming urinal, and wherein the communication enables the gaming urinal and the at least one other gaming urinal to facilitate a multiplayer, competitive game between users.

In yet another embodiment, the invention is directed to a gaming urinal, including a urinal body, including a back wall and a lower bowl, wherein the lower bowl includes a drain, a play screen extending outwardly from the back wall of the urinal body, the play screen including a transparent cover, a display panel, a force detection layer, wherein the force detection layer includes a polyethylene terephthalate (PET) film with a plurality of shunt mode resistors, and at least one gasket providing a watertight seal, wherein the force detection layer is configured to detect a location of force applied by a urine stream on the front of the play screen, wherein the display panel interactively changes what is displayed based on where the force is detected by the force detection layer, and wherein the play screen is positioned at an upward angle relatively to the back wall of the urinal body.

BRIEF DESCRIPTION OF THE DRAWINGS

FIG. 3 is a diagram showing the layers of a central panel of a gaming urinal system according to one embodiment of the present invention.

DETAILED DESCRIPTION

Figure 1A:
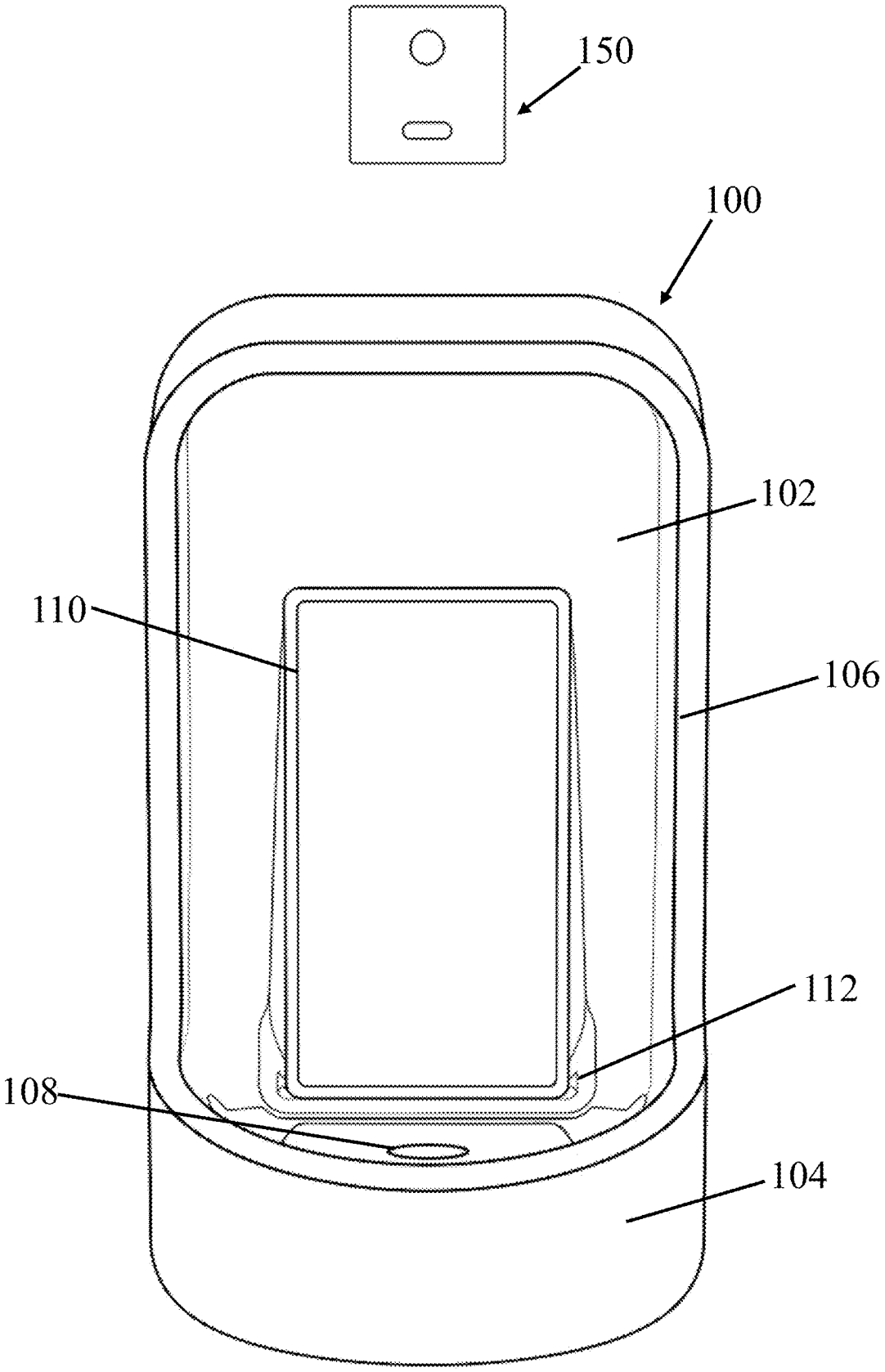
FIG. 1A is a front perspective view of a gaming urinal system according to one embodiment of the present invention.
Figure 1B:
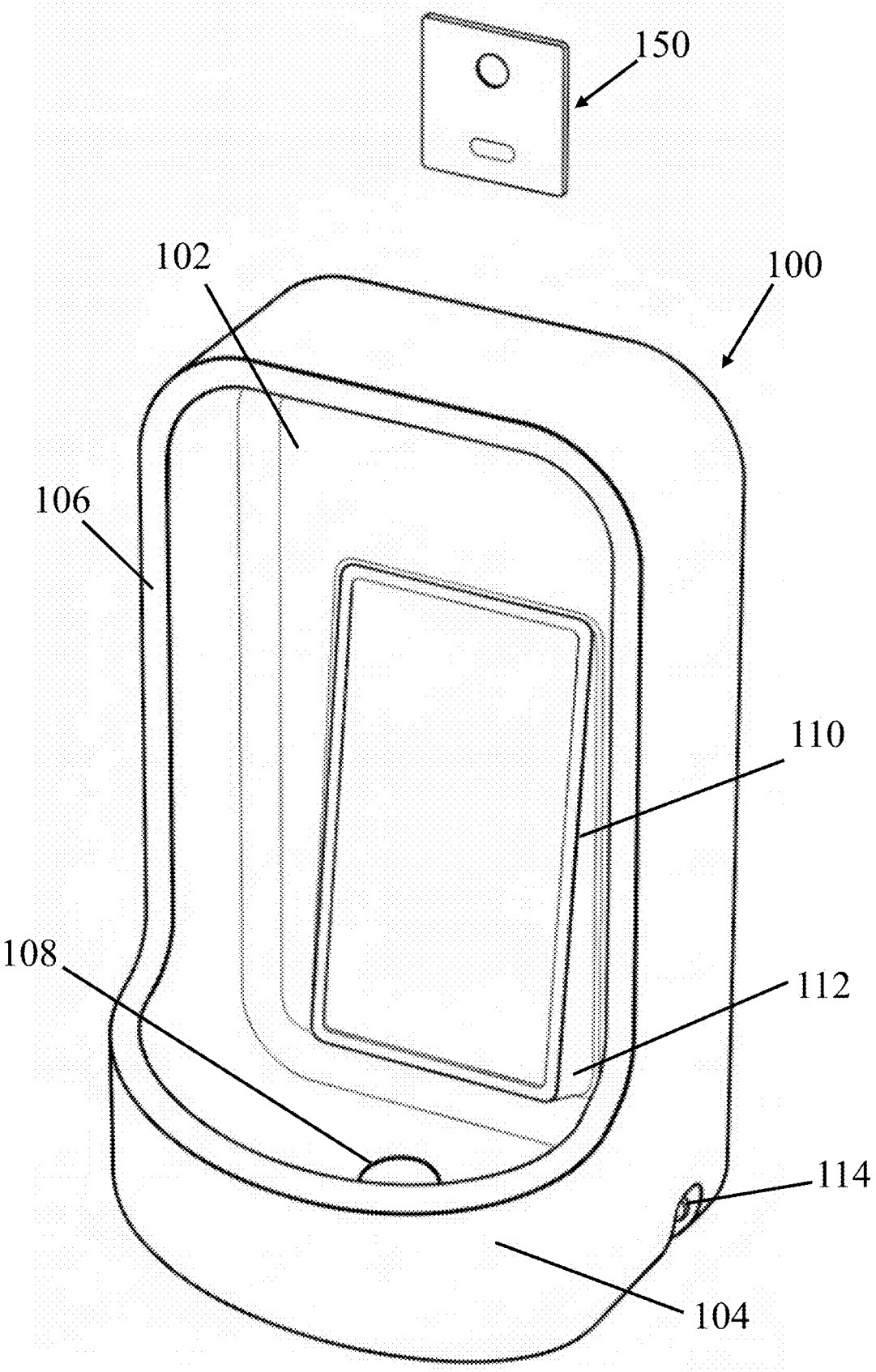
FIG. 1B is a side perspective view of a gaming urinal system according to one embodiment of the present invention.
Figure 1C:
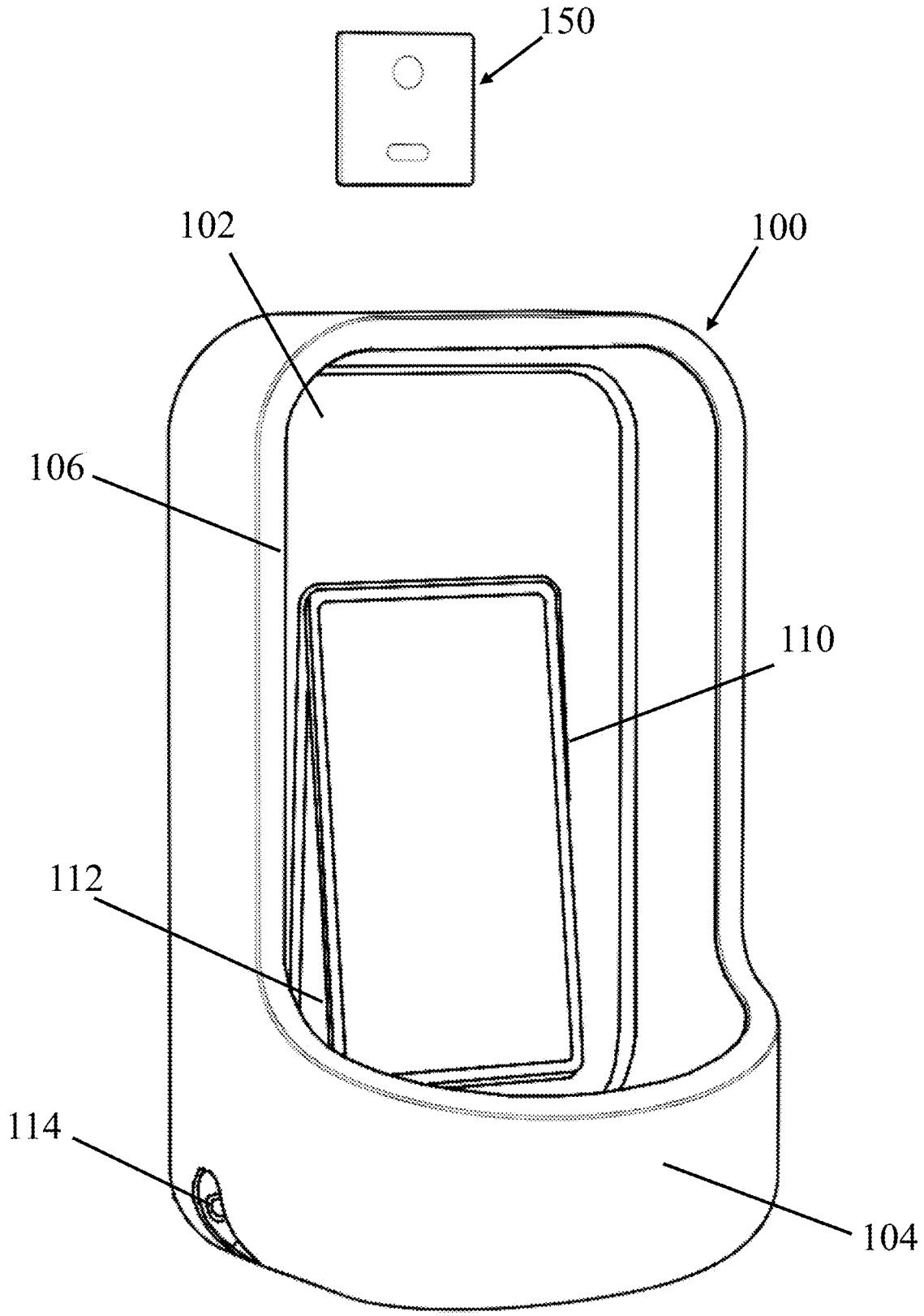
FIG. 1C is a side perspective view of a gaming urinal system according to one embodiment of the present invention.
Figure 1D:
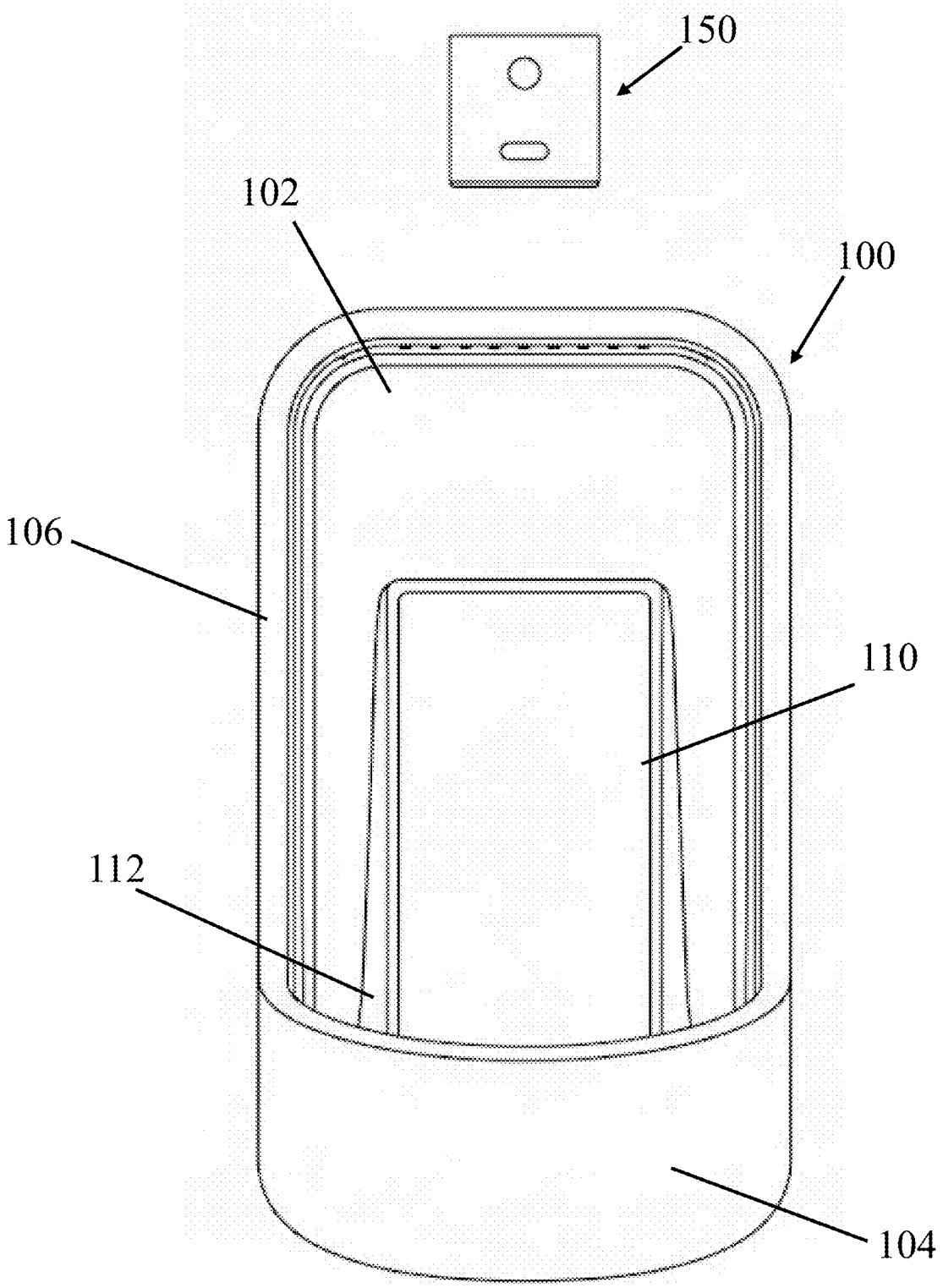
FIG. 1D is a front orthogonal view of a gaming urinal system according to one embodiment of the present invention.
Figure 1E:
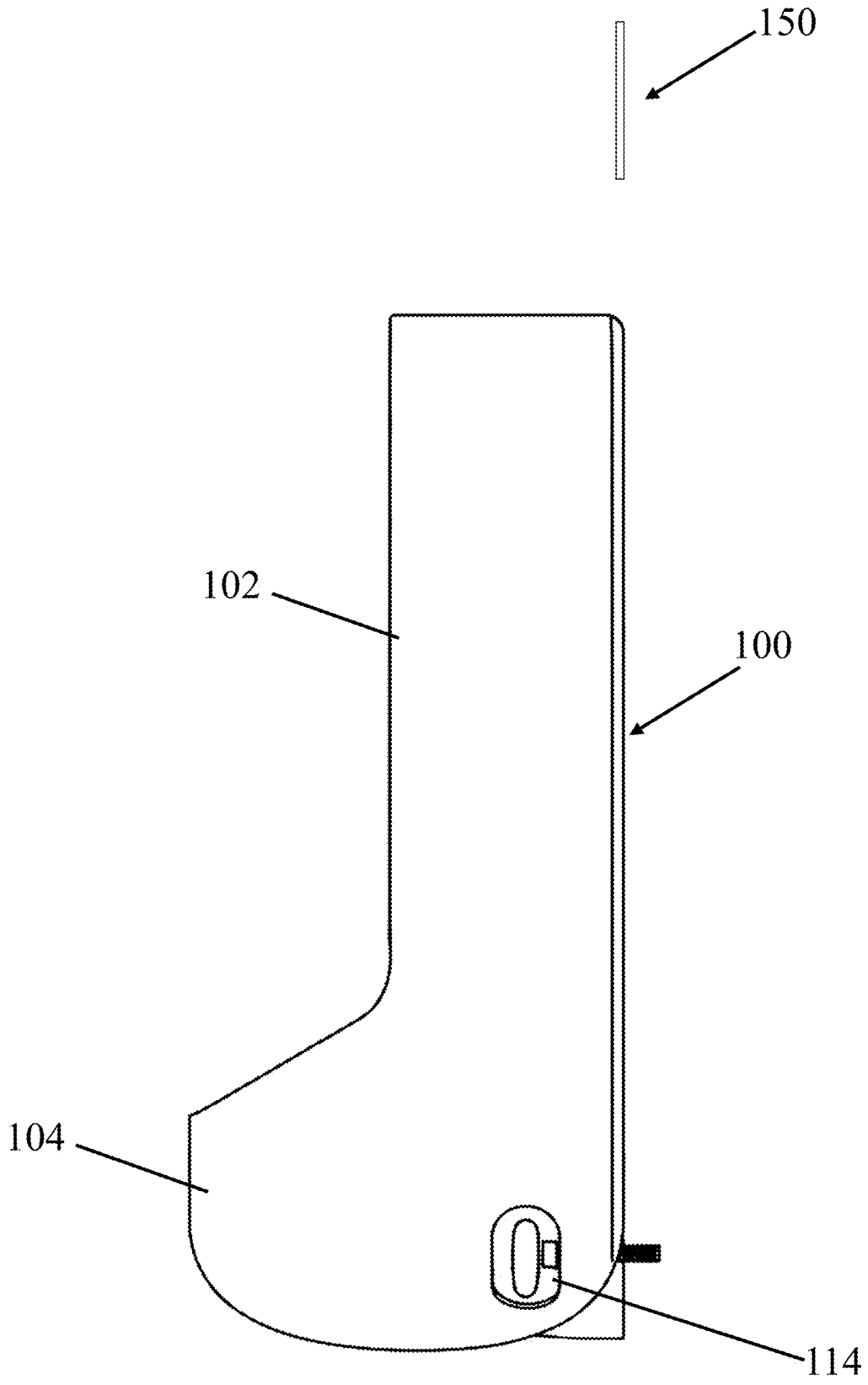
FIG. 1E is a side orthogonal view of a gaming urinal system according to one embodiment of the present invention.

The presently disclosed subject matter is described with specificity to meet statutory requirements. However, the description itself is not intended to limit the scope of this patent. Rather, the inventors have contemplated that the claimed invention might also be embodied in other ways, to include different steps or elements similar to the ones described in this document, in conjunction with other present or future technologies.

Bars, clubs, and other establishments are often looking for ways to increase average happiness of guests and to develop a distinct theme and identity that helps to attract new customers as well as retaining old customers. The quality of the bathroom of an establishment can often have an effect on whether customers wish to return or not, and, even for strongly themed establishments, is often neglected as something separate to and apart from the themed experience of the establishment. Much of bathroom quality has traditionally been concerned with cleanliness, but untapped potential differentiator also includes fun or engagement when using the bathroom.

Disclosed herein are systems and apparatuses for providing a fun and interactive gaming experience while using a urinal in a bathroom of an establishment, such as a bar or club. By providing such an experience in the bathroom, customers' average satisfaction can be increased, and the games, visuals, sounds, or lighting of the experience can be used to enhance a theme or atmosphere of an establishment. This is easily the case where the establishment has a gaming theme already, but the games are able to be tailored to fit other themes as well (e.g., medieval theme, space theme, tiki theme, etc.) thereby improving the immersion of the establishment.

Furthermore, gamification of customers peeing can have additional benefits apart from fun and engagement, particularly on cleanliness. In bars and clubs especially, the drunkenness of customers often leads customers to have poor air in the bathroom, leading to urine on the walls and floors, or at least covering too much of the exterior parts of the urinal. By providing a gamified incentive to aim in the bowl of the urinal, cleanliness can be improved despite the drunkenness of customers.

The system of the present invention provides an interactive display screen able to provide many different types of games for a diversity of experiences for customers as well as for a diversity of options to fit a theme or other goals of an establishment for establishment owners. Furthermore, the use of a pressure sensitive display screen for gameplay allows game objects to be dynamic and for complexity of gameplay to be improved relative to a system that uses a single static pressure sensor or a non-display-based interactive component.

Prior art systems and methods for smart urinals and interactive urinals exist but possess distinct differences and failings when compared to the present invention. For example, U.S. Pat. No. 10,604,924 discloses a "smart urinal" that includes a display screen and a pressure sensor target for a type of gaming experience. However, the display screen in the '924 patent is separate from the pressure sensor target, and the display screen does not interact with the urine stream. Therefore, the only game playable in the system of the '924 patent is to hit a stationary target. This makes sense with the goals of the '924 as a urine collector for health analysis of the urine, as the target is used for encouragement such that the urine can be collected. Even where the display screen can be interacted with in the '924 patent to play games, these games are played by hand, thereby distracting the user from peeing and likely having a detrimental effect on the user's aim and therefore on the cleanliness of the location.

Similarly, U.S. Pat. No. 9,550,115 presents a urinal gaming system that includes a pressure sensitive target and a display screen far above the urinal, for use in displaying a leaderboard or other such information. While the display screen in the '115 patent is a touch screen, it is also interacted with by hand and is not meant to contact a urine stream, as the pressure sensitive target contacts the urine stream instead. Like the '924 patent, the '115 patent only discloses a game of hitting a stationary target, and the system is limited from being able to branch out from that game other than perhaps by making the target a different shape.

A multiplayer urinal game is presented in U.S. Pat. No. 11,443,597. This system includes a shared, non-interactive display screen that receives data from volume flow meters in different urinals and uses that to show, for example, different meters filling or different urinals as horses in a horse race where more flow moves a player's horse along the track. This gaming system, however, is very limited as to the diversity of games that may be played and interactivity is very low, as the games are fairly purely reliant on volume flow, with aim being largely irrelevant. As the progress of these games is largely dependent simply on the volume of urine in the players' bladders, the graphics shown on the display are more analogous to a progress bar of a person sitting in an elevator than an interactive game.

Thus, what is needed is a gaming urinal system that provides a greater degree of diversity of gameplay, both within one game and between several games. However, the broader market need in the art for a gaming urinal that utilizes a full, interactive display screen to provide greater variety and interactivity of gameplay also comes with a need for a technical system able to satisfy this goal. Importantly, the prior art is not considered with sensor sensitivity, as the prior art systems are able to accommodate both closer contact with a sensor array and require less sensitivity in the sensor array broadly due to the simplicity of the games described. However, when employing an interactive display screen, there is a need for a system with high sensitivity to forces on different parts of the screen, as the amount of force exerted by a urine stream is far less than would be expected with a traditional touch screen.

FIGS. 1A-1E shows various views of a gaming urinal system according to one embodiment of the present invention. A gaming urinal 100 includes a back wall 102 extending upwardly from a lower bowl 104. Preferably, the back wall 102 and lower bowl 104 are integrally formed as a single component, such that the urinal, as a whole has an approximately L-shaped side profile. Surrounding the back wall 102 and the lower bowl 104 is a single lip 106, such that the back wall 102 and lower bowl 104 are recessed. The lower bowl 104 includes a drain 108, into which urine flows and is subsequently expelled to a building plumbing system. Preferably, the lower bowl 104 is shaped with curvature such that substantially all urine in the urinal 100 flows into the drain 108.

One of ordinary skill in the art will understand that the exact shape and design of the urinal shown in FIGS. 1A-1E is not intended to be limiting, and urinals with other standard or non-standard shapes are also considered herein. For example, while the back wall 102 of the urinal 100 shown in FIGS. 1A-1E is substantially flat, urinals with a curved, concave back wall is also contemplated herein. Furthermore, while the back wall 102 of the urinal 100 shown in FIGS. 1A-1E has a length substantially greater than the depth of the lower bowl 104, urinals with a more even ratio between the back wall and lower bowl are also contemplated herein, as are those with a back wall shorter than the depth of the lower bowl.

In one embodiment, the urinal 100 is in communication with an automatic flush system 150, which causes the urinal to flush once an individual has finished peeing and walks away. In one embodiment, the automatic flush system 150 includes a panel with a sensor for detecting whether an individual has moved away from the urinal 100. Preferably, the sensor includes an infrared (IR) sensor and/or a passive infrared (PIR) sensor, though other sensor types, including ultrasonic sensors are also contemplated herein. When the sensor detects that an individual is no longer present, it sends a signal to the urinal 100 to flush. The automatic flush system 150 may also include a physical button, which, on being pressed, causes the flush signal to be sent to the urinal 100. Other flush mechanisms, including a traditional toilet handle flush mechanism, are also contemplated herein and the invention is not intended to be limiting as to the type of flush mechanism used. In one embodiment, the flush mechanism provides for different intensities of flush, depending on which mechanism is used to initiate the flush (i.e., multiple buttons for different flush intensities), force with which the mechanism is activated, and/or one or more other factors.

Importantly for the use of the gaming urinal 100, a play screen 110 extends from and covers part of the back wall 102 of the urinal 100. The play screen 110 may be tilted upwards in a mount 112 of the back wall 102, such that it is tilted towards the person peeing, or it may be flat against the back wall 102. The play screen 110 may be tilted at various non-limiting angles, such as a 20° angle. The angle at which the play screen 110 is placed is able to vary, balancing visibility to the user looking down at the urinal and the desire to control the amount of splash. Angles may range from 10-25° or may vary even more greatly between 5° and 30°. The play screen 110 may have a substantially rectangular shape, as shown in FIGS. 1A-1E, or may have any other shape, including circular or elliptical shapes, among others. The play screen 110 may partially extend below the lip 106 of the lower bowl 104, or it may be entirely above the lip 106, with preferred placement depending on the dimensions and geometries of the urinal 100 as a whole.

Preferably, the gaming urinal 100 is a wall-mounted urinal, mounted using one or more mounting sections 114. The mounting sections 114 include a notch in the body of the urinal 100, near the back of the urinal 100, where the mounting sections 114 accommodate mounting means for attaching to a wall. The mounting means may include screws, bolts, nails, strong adhesives, and/or other means. The embodiment shown in FIGS. 1A-1E includes holes in two mounting sections 114 on the left and right sides of the urinal 100, with long bolts extending through those holes and into the wall behind. However, different placement of the mounting sections 114, or the use of additional mounting sections 114 is also contemplated herein, as is the use of a free standing urinal 100, supported from the bottom, rather than attached to a wall. Furthermore, the two mounting sections, or other mounting means, may be used to mount the urinal to the floor in addition to or instead of mounting the urinal to a wall.

One of ordinary skill in the art will understand that different sizes of the urinal are contemplated herein, accounting for different heights of users as well as providing for versions accommodating younger users as well. For example, one version of the urinal may be used to assist in the potty training of children by providing a gamification element to the potty training.

The urinals 100 are able to be provided in a variety of colors, so as to be able to match a theme or décor of a bathroom or an overall establishment.

Figure 2:
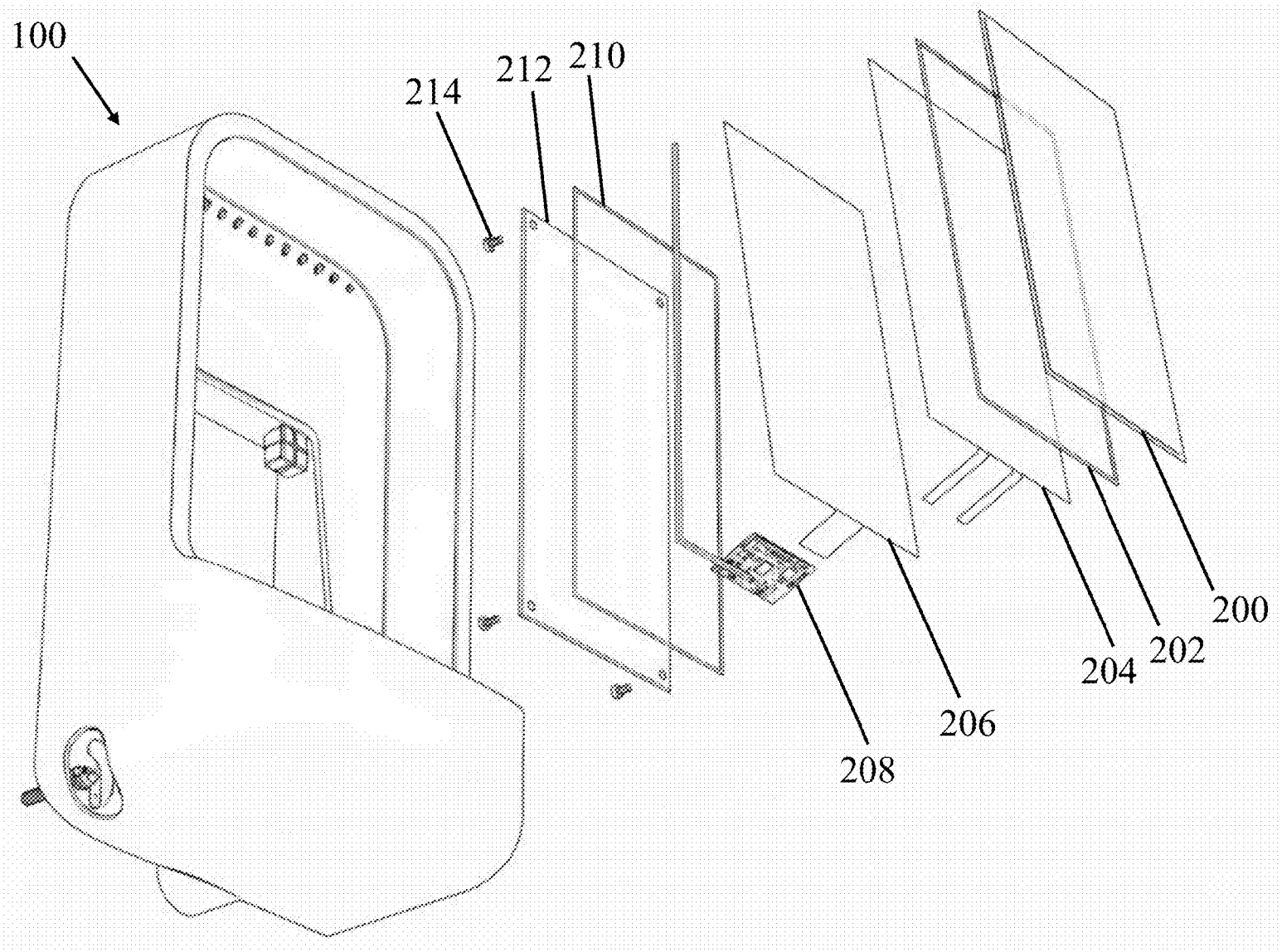
FIG. 2 is an exploded view of a gaming urinal system according to one embodiment of the present invention.

FIG. 2 is an exploded view of a gaming urinal system, providing a view of the layers of the play screen that enable an interactive experience triggered by a urine stream. FIG. 3 provides a schematic diagram of these layers. A transparent cover 200 is the exterior component of the play screen, providing a smooth finish and protection of the electronics of the play screen from splash by water or urine that could damage the functionality of the device. The transparent cover 200 is able to include a thin glass layer and/or a thin, transparent polymer layer. Transparency is important so as to ensure that visuals displayed on the screen are not obscured by the panel. Similarly, it is important that the cover 200 be thin such that the modest force of the urine stream is still able to be detected by the interactive play screen. Coverage of the screen by the transparent cover 200 is sealed by a screen gasket 202, preventing water or urine ingress around the edges of the cover 200. The screen gasket 202 is able to include materials such as rubber, silicone, polytetrafluoroethylene (PTFE), and compressed non-asbestos fiber (CNAF), though the screen gasket 202 is not limited to these materials.

Behind the transparent 200 is a display screen 204, which displays interfaces for interactive games. The display screen 204 may be an organic light-emitting diode (OLED) display, a liquid-crystal display (LCD), a microLED display, a mini-LED display, and/or any other type of display suitable for rendering an interactive game. Just behind the display screen 204 is a sensitive force detection layer 206 (e.g., force-sensing resistor (FSR) matrix), configured to detect the location of the small amount of force exerted by a urine stream on the front of the play screen, thereby allowing interactivity with the interactive game displayed on the display screen 204. The force detection layer 206 may be a polymer film with an array of printed force sensors arranged across its area such as an FSR matrix. Pressure exerted on one or more of these sensors as a result of the force of the urine stream is translated to an electrical signal. It can therefore by detected which force sensors are delivering the signal and therefore the location of the force is known. The polymer film of the force detection layer 206 may be a polyester film (e.g., polyethylene terephthalate). Preferably, the printed force sensors are shunt mode sensors. However, the use of thru mode sensors, or a combination of shunt and thru mode sensors, is also contemplated herein. In one embodiment, the sensors have an actuation force of 0.1N or below and a sensitivity range up to approximately 10 N, 20N, or higher, however the actuation force and sensitivity range are able to be adjusted as needed. Preferably, the sensors are ultra-thin to allow for inclusion in a thin screen. For example, in one embodiment, the sensors are approximately 0.35 mm thick, although the sensors are able to be provided in a range of thicknesses, such as from 0.2 mm to 1.5 mm. Additionally, the sensors individually cover a relatively small area, allowing many sensors to be included for improved touch resolution. One example may have sensors with a diameter of approximately 7.6 mm, but are able to exist in a wider range, at least spanning 2 mm to 25 mm. In one embodiment, the sensors are FSR 400 sensors from INTERLINK, the specifications of which are incorporated herein by reference.

Versions of the gaming urinal without a display panel may also be provided. In order to improve the force sensitivity and resolution of the force detection layer, the display panel may be removed, allowing the force detection layer to be placed closer to the top surface of the play screen. To replace the play screen while still providing interactivity, the gaming urinal may instead utilize a projector, projecting an image of the game onto the play screen. The projector may, for example, be positioned in a top surface of the body of the urinal and directed downward to project on the play screen. In this version, it is preferable that the rim of the urinal, most especially the top rim, be extended further outward in order to darken the interior of the urinal and thereby more easily allow the projected screen to be seen. In terms of interactivity, the projected screen may work substantially the same as the display panel, with what is projected onto the play screen being interactively affected by the sensor readings of the force detection layer, as signals from the sensors of the force detection layer are transmitted to a microcontroller also controlling the projector.

Alternatively, a projected screen system may also be provided without a force detection layer as well. In this version, cameras or other visual sensors are provided with the projector and detect points at which the projected screen is disrupted to determine the location of the urine stream. In this manner, the visual sensors provide for a similar type of interactivity as the force detection layer, but with the critical electronics of the projector, visual sensors, and preferably also the microcontroller being positioned near the top of the urinal, with fewer electronics near the base or drain of the urinal, thereby also being less susceptible to water damage.

The force detection layer 206 may include a conformal coating, providing the play screen with additional resistance to water or urine ingress beyond the protection provided by any gaskets.

A printed circuit board (PCB) 208 connected with a power source, including grid power or one or more batteries, provides control logic for the display and the force detection layer, as well as communication with other gaming urinals, as discussed below. In one embodiment, the gaming urinal 100 uses a single PCB 208 or set of PCBs for both the play screen and other functionality of the urinal, including communication with the automatic flush system. However, the control electronics for the automatic flush system and other such functionality of the urinal may also be separate and distinct from any control mechanisms for the play screen.

A back panel 212 of the urinal 100 is positioned behind the force detection layer 206 and creates an enclosed environment for the play screen. Preferably, the back panel is flush with the back surface of the urinal 100, such that the back of the urinal 100 is substantially flat when it is installed. The back panel is able to be secured by one or more screws 214, as shown in FIG. 2, or with other means, including adhesive, a click connect mechanism, latches, and/or other means. A removable back panel 212 is useful, as it allows the play screen to be repaired or replaced without replacing the entire urinal 100 and without potentially breaking the front of the screen via front access and attempted removal of the transparent cover 200. The back panel 212 is sealed with at least one panel gasket 210, to prevent water or urine ingress from the back of the urinal 100. Similarly to the screen gasket 202, the panel gasket 210 is able to include materials such as rubber, silicone, polytetrafluoroethylene (PTFE), and compressed non-asbestos fiber (CNAF), though is not limited to these materials.

The play screen may include internal speakers, sealed between the transparent cover 200 and the back panel 212, such that the game can provide audio feedback and sound effects during gameplay. Additionally or alternatively, the play screen may be in communication with an external speaker system, located in a place unlikely to be affected by water or urine, such as mounted on the wall between the urinals. Speakers, including internal or external speakers, may be waterproof, so as to prevent damage during use of the gaming urinal. Other versions of the present invention may include no speakers at all and may be limited to only visual displays, without corresponding audio, thereby simplifying construction and reducing noise in the bathroom where the urinal(s) are installed.

Other versions of the gaming urinal may utilize, as the force detection layer, arrays of piezoelectric sensors or piezoresistive sensors in addition to or, more likely, as an alternative to an FSR matrix, providing for an alternative means of detecting force and/or determining a location of impact applied on the play screen. Generally, the force detection layer is preferably a conductive force sensing layer, though inductive force sensing layers are also contemplated herein. Furthermore, capacitive sensors may be used for detecting the location of the impact of the urine stream as well. Any type of capacitive sensor is able to be used as the impact, pressure, or force sensing layer, including both self-capacitance and/or mutual capacitive sensors.

Figure 4:
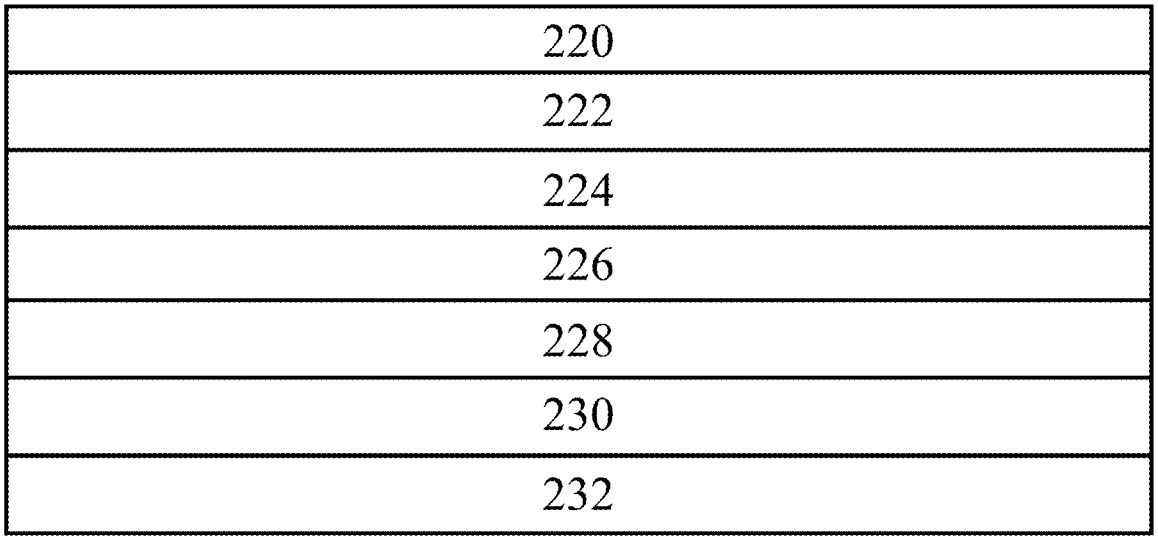
FIG. 4 is a diagram showing the layers of a central panel of a gaming urinal system according to one embodiment of the present invention.

FIG. 4 is a diagram showing the layers of a central panel of a gaming urinal system according to one embodiment of the present invention. In one embodiment, the play screen includes an outer transparent layer 220, which may be formed from polyethylene terephthalate (PET). This outer transparent layer 220 provides a protective cover for the play screen and, being sealed by a gasket, also provides for protection against water or urine ingress.

Beneath the outer transparent layer 220 may be a force distribution layer 222. Preferably, the force distribution layer 222 is also formed from a transparent polymer, such as thermoplastic polyurethane (TPU). The force distribution layer 222 provides further protection for the display panel, while also helping to distribute force evenly across the play screen. The use of a material such as TPU allows for improved shock absorption and force distribution in the force distribution layer 222 as opposed to the more rigid PET used for the outer transparent layer 220.

The display screen 224 is positioned below the force distribution layer 222. The display screen 204 may be an organic light-emitting diode (OLED) display, a liquid-crystal display (LCD), a microLED display, a mini-LED display, and/or any other type of display suitable for rendering an interactive game.

The force detection layer 228 is positioned beneath the display screen 224. A mechanical preload 226 may also be placed between the force detection layer 228 and the display screen 224. A mechanical preload 226 is able to include a layer of air or an inert gas, providing a gap between the force detection layer 228 and the above layers. A small mechanical frame may be provided around the edges of the screen between the force detection layer 228 and the display screen 224 in order to provide for the gap constituting the mechanical preload 226. ‘

The force detection layer 228 may be placed on a mechanical frame 230 serving as a backing for the play screen on which the above layers are placed. The mechanical frame 230 and the play screen as a whole all exist in front of the back panel 232 or a section of the back wall of the urinal.

Similar to the embodiment of the gaming urinal provided in FIG. 3, versions of the gaming urinal without a display panel may also be provided. In order to improve the force sensitivity and resolution of the force detection layer, the display panel may be removed, allowing the force detection layer to be placed closer to the top surface of the play screen. To replace the play screen while still providing interactivity, the gaming urinal may instead utilize a projector, projecting an image of the game onto the play screen. The projector may, for example, be positioned in a top surface of the body of the urinal and directed downward to project on the play screen. In this version, it is preferable that the rim of the urinal, most especially the top rim, be extended further outward in order to darken the interior of the urinal and thereby more easily allow the projected screen to be seen. In terms of interactivity, the projected screen may work substantially the same as the display panel, with what is projected onto the play screen being interactively affected by the sensor readings of the force detection layer, as signals from the sensors of the force detection layer are transmitted to a microcontroller also controlling the projector.

Alternatively, a projected screen system may also be provided without a force detection layer as well. In this version, cameras or other visual sensors are provided with the projector and detect points at which the projected screen is disrupted to determine the location of the urine stream. In this manner, the visual sensors provide for a similar type of interactivity as the force detection layer, but with the critical electronics of the projector, visual sensors, and preferably also the microcontroller being positioned near the top of the urinal, with fewer electronics near the base or drain of the urinal, thereby also being less susceptible to water damage.

Other versions of the gaming urinal may utilize, as the force detection layer, arrays of piezoelectric sensors or piezoresistive sensors in addition to or, more likely, as an alternative to the FSR matrix, providing for an alternative means of detecting force and determining a location where the force is applied on the play screen.

Figure 5:
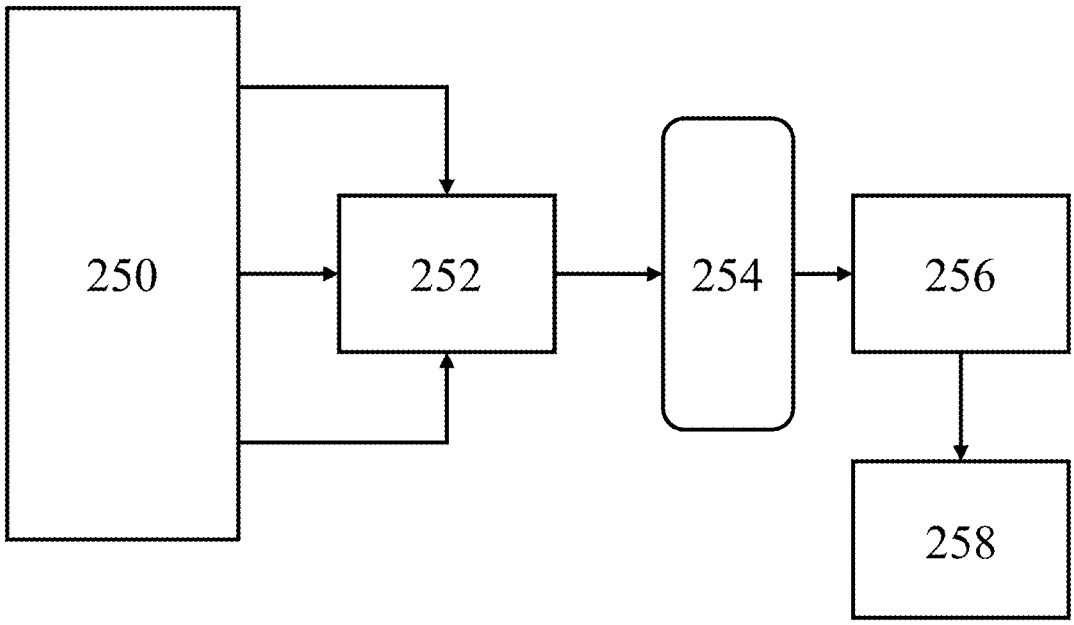
FIG. 5 is a diagram of a signal path for signals from a force detection layer of a central panel of a gaming urinal according to one embodiment of the present invention.

FIG. 5 is a diagram of a signal path for signals from a force detection layer of a central panel of a gaming urinal according to one embodiment of the present invention. Whether the layers of the play screen match those shown in FIG. 3, FIG. 4, or are a different configuration, an important aspect in providing a system with sufficient spatial sensitivity is the processing of the sensor data. In particular, the system includes an amplification circuit for amplifying the signals produced by the sensors of the force detection layer 250 and for reducing the signal-to-noise ratio (SNR). Signals from the force detection layer 250 are processed by a multiplexer 252 before being converted to digital signals by an analog-to-digital-converter (ADC) 256 and finally being received by a microcontroller 258. Edge algorithms are able to be employed at the microcontroller 258 to further define differentiation of the location of incoming signals, for improved resolution in both the x and y axes of the force detection layer.

Preferably, the signals are filtered through one or more filters 254 between the multiplexer 252 and the ADC 256 so as to further reduce SNR. The one or more filters 254 may preferably include one or more low pass filters but may also include one or more band-pass filters and/or one or more high-pass filters. In addition to or alternative to the one or more filters 254, one or more amplifiers may also be used to process the signal so as to amplify the signal strength.

The multiplexer 252 may be a 74 HC multiplexer, or any other suitable 8-channel or 16-channel multiplexer. The ADC 256 may be an MCP3208 ADC, or any other suitable 8-channel, 16-channel, or N-channel ADC.

Figure 6:
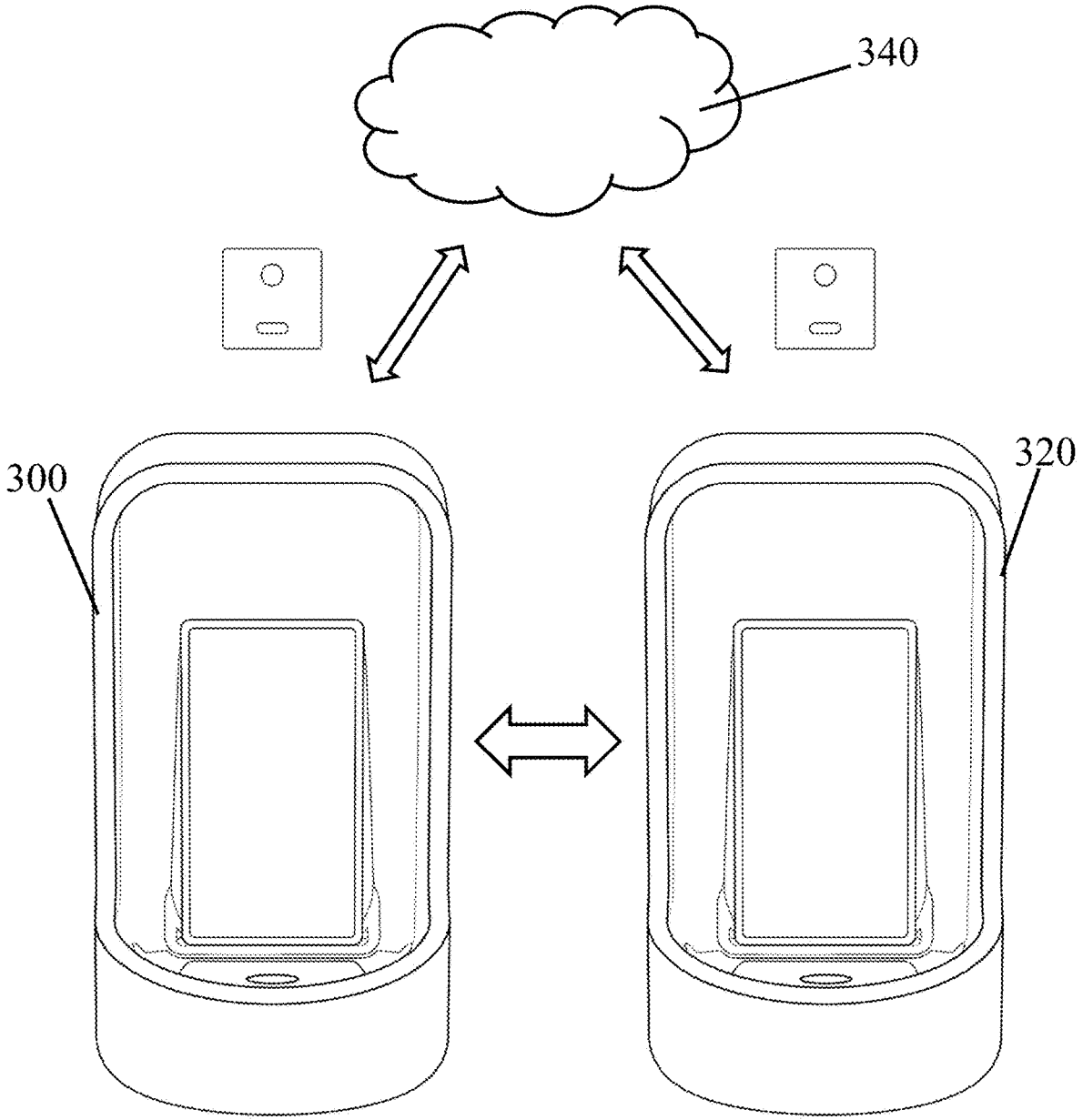
FIG. 6 is a schematic diagram of a system of multiple communicating gaming urinals according to one embodiment of the present invention.

FIG. 6 is a schematic diagram of a system of multiple communicating gaming urinals according to one embodiment of the present invention. The system of the present invention also supports multiplayer games via communication between multiple urinals, such as adjacent urinals. The diagram of FIG. 6 shows communication between a first urinal 300 and a second urinal 320, though any number of urinals may be made to communicate. Communication allows for improved interactivity of gameplay, such as comparing scores of those using the urinal at the same time, determining a winner of a multiplayer game, or even simultaneous manipulation of the same game object from different urinals. An example of the latter is a game where a ball, such as a soccer ball, is moved upon detection of force at the location of the ball on the display. The location of force being applied and the location of the ball may be shared between communicating urinals allowing players to compete back-and-forth in real time to move the ball to a goal. The inclusion of communication between urinals also allows for the creation of a global leaderboard of scores for different games between all urinals in a location. The urinals are able to be configured to allow communication and competition between specific designated urinals. For example, for a bathroom with 6 urinals, urinals 1 and 2 are set to communicate, along with the pairs of 3 and 4, and 5 and 6. Alternatively, all 6 urinals can be made to communicate.

Communication between urinals is able to happen via different means. In a first communication system, urinals directly communicate with each other, with no need to contact a remote server. This communication paradigm has advantages, as it does not rely on external communication, which may be interrupted due to a storm or another cause of internet outage. Alternatively, the urinals could communicate via a server 340 as an intermediary. The server 340 may be a remotely located cloud server, or may be a local server (e.g., stored in the same building as the urinals themselves). The user of a server 340 intermediary also allows the system to pull global leaderboards between locations, push over-the-air (OTA) updates to the urinals, and/or provide other benefits associated with internet connection. Additionally, the use of a local server allows for easier logging of communication traffic between urinals.

The network type used to communicate between the urinals is not intended to be limiting herein. For example, BLUETOOTH and WI-FI networks, as well as other wireless personal area network (WPAN) or wireless local area network (WLAN) types are able to be utilized, as facilitated by a wireless communication module of the microcontroller. Another protocol able to be used for wireless communications is ESP-NOW, especially where the microcontrollers included in the gaming urinals are ESPRESSIF microcontrollers (e.g., ESP32, ESP8266, etc.).

Figure 7:
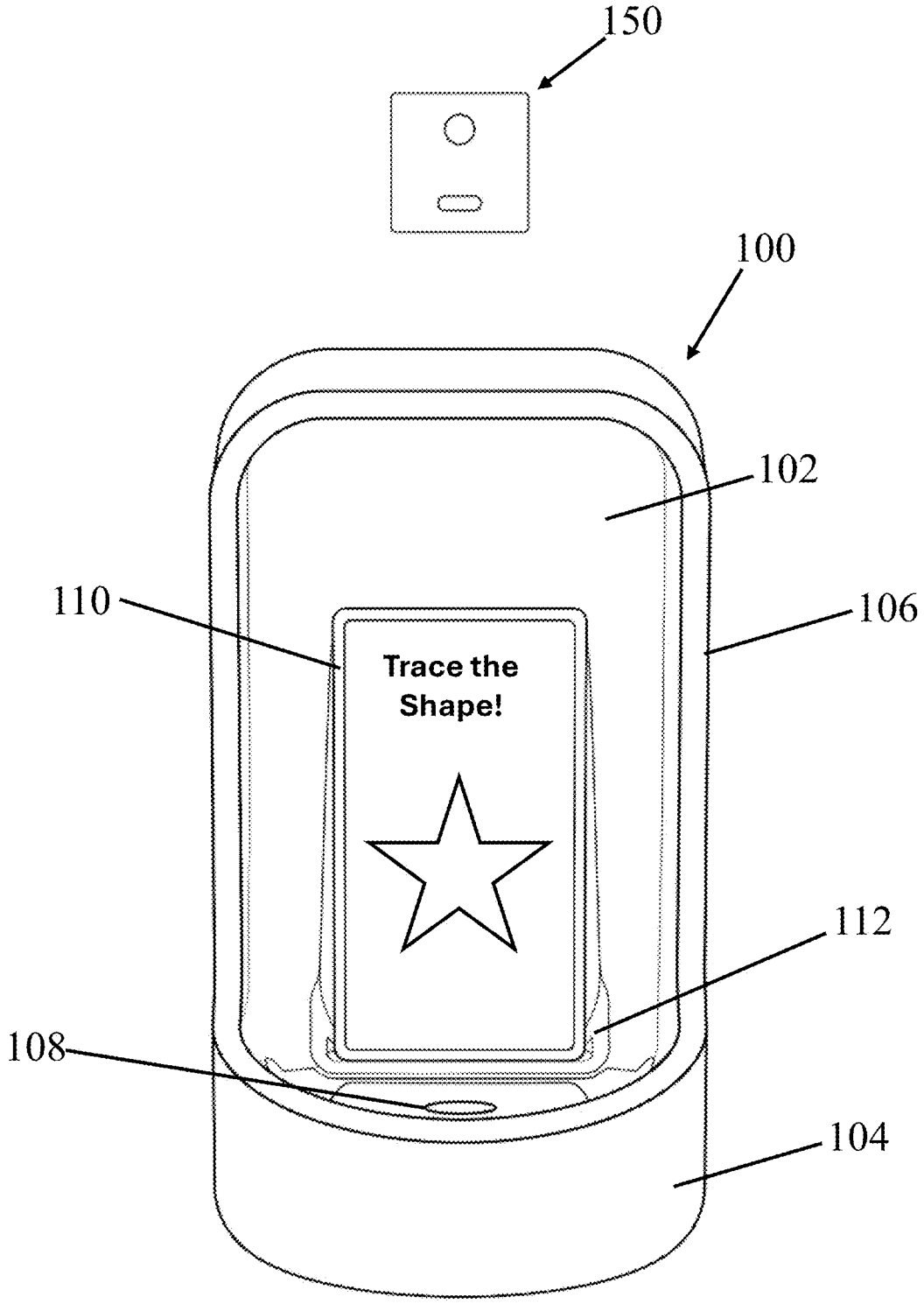
FIG. 7 is a front perspective view of a gaming urinal system with a shape tracing game active according to one embodiment of the present invention.

FIG. 7 is a front perspective view of a gaming urinal system with a shape tracing game active according to one embodiment of the present invention. The games able to be played on the gaming urinal 100 may include a challenge to draw certain shapes with the urine stream, including simple shapes such as triangles or stars, or more complex images like a person, house, or other objects. Drawing games may either display an outline for the user to trace or allow the user to "free draw" the shape on an empty display canvas. The game may change the object to be drawn if the game detects that the user has adequately drawn the shape or otherwise completed drawing the shape, or the drawing prompt may change at preset time intervals.

A target game is another non-limiting example of a type of game that may be played on the gaming urinal. With the target game, for each second force is detected on part of the target, the player gains a certain number of points depending on the location of the force relative to the target. For example, a bullseye is 500 points per second, while the edge of the target is 10 points per second. With the target game, and with other games played on the gaming urinal, it is often advantageous to determine whether the location of greatest force is even if there is some amount of force applied to multiple locations. This is advantageous, as the urine stream may cause some urine to backsplash onto the screen with small amounts of force and the urine stream itself is not always pinpoint to a single location. Therefore, by filtering out the location of strongest force and using that as the determining factor for interaction with the touch screen, the center of the urine stream may be approximated. The target need not necessarily be a traditional circular target but can be other shapes and the highest value points need not necessarily be in the middle of the target. In one embodiment, for example, the target is shaped as a dinosaur, where hitting the head of the dinosaur is worth more points than hitting the body. In some versions of the game, the target moves or bounces around over time. In versions where the target is moving, the focus may be on following the target (or another object not necessarily shaped as a target). The shape of the target object may also change over time, either changing after a preset amount of time or after a certain number of points are accumulated from the target. For example, if the first target is shaped like a dinosaur, after the user has depleted a preset number of "hitpoints" from the dinosaur, a different dinosaur or another creature may appear and become the new target.

The games able to be played on the gaming urinal are not limited to hitting a target or tracing a shape. Another possible game improves a complex structure with enemies within. By directing the urine stream to hit particular supports of the building, the building can be made to collapse on the enemies. Which supports are removed and the order they are removed therefore impacts how the building collapses. The building can also include allied characters that the player does not wish to be crushed by the building collapse.

Another game able to be played on the gaming urinal involves directing a stream to hit different objects flying past the screen at different speeds, along different paths, and/or moving along different arcs. This gives the player the feeling of shooting, slicing, or otherwise affecting the game objects.

The games may include a racing game where a player object (e.g., a vehicle, a running person, etc.) moves to the left or right depending on which side of the screen the urine stream is detected on. By moving to the left or right, the player vehicle may avoid obstacles or pass other players. The game may also detect whether a urine stream impacts a top or bottom of the screen to allow the player object to jump or pass under obstacles as needed. The game may include power ups for player to collect by colliding the player object with the power up or collecting a minimum number of coins. The player object may exist in a limited number of discrete left-to-right positions (e.g., 3 positions, 5 positions, etc.) or may move continuously from left to right. In one embodiment, the speed of the player object may be affected by the degree of force detected from the urine stream.

The games may also include a rail shooter style game, where movement of the perspective of the player occurs along a fixed route, but where various enemies or targets appear to hit to the left, right, or dead ahead of the player. Furthermore, targets may appear that the player is penalized for hitting as well as those that the player is rewarded for hitting.

One of ordinary skill in the art will understand that the games mentioned above are purely exemplary and that a number of additional games are also to be provided according to the present invention. For example, a whack-a-mole style game is also contemplated herein.

One version of the gaming urinal allows for user selection of the game they want to play. For example, when a user approaches the urinal, the graphical user interface (GUI) of the play screen displays icons for different games. By aiming the urine stream onto one of the icons, a game is chosen. More preferably, gaming urinals can be preset to play a particular game by an administrator, allowing for tighter theming and quicker interaction with the gameplay. The gaming urinal is also able to be set to have the preset game for each gaming urinal be changed at predetermined time intervals (e.g., every 30 minutes, every hour, every day, etc.) where the time intervals and the rotation of games are also able to be set by an administrator or left as a default value. The automatic change of the game provides a greater variety of experiences for users within a single visit to the location or across multiple visits to the location. Furthermore, games may be preset for each urinal on a longer-term, calendar basis, allowing for preset seasonal, monthly, or holiday-related games or seasonal, monthly, or holiday-related reskins for the same games.

Another useful aspect of the gaming urinal for the operator of an establishment is for the urinal to provide advertising. For example, when not in use for a preset period of time, the gaming urinal may display a screen saver that displays one or more advertisements. The advertisements of the screen saver may remain static or alternate between different advertisements after a preset period of time. One version of the gaming urinal switches from the screen saver to the game when the impact from a urine stream is detected on a play screen. Another version of the gaming urinal includes an infrared sensor, either passive or time-of-flight, configured to detect when a user is present or approaching the urinal. When the user is detected by the infrared sensor, the display screen automatically switches from the screen saver to the game, without needing to wait for the detection of a urine stream. This infrared sensor may be an independent sensor used entirely for the control of the play screen, or may be the same as an infrared sensor used to detect the user for operating the automated flush system.

In instances where a time-of-flight sensor is used, sensor data from the time-of-flight sensor may also be used to detect when a user is leaning one way or another. This may be used as a game input for games that require the user to lean in different directions (left vs right, or forward vs backward), or may be used as an input to penalize the player when they are heavily leaning during gameplay, so as to encourage more sanitary conditions.

Furthermore, advertising may be incorporated into the games. One version of in-game advertising applies a digital watermark or other brand logo over part of the game in a way that is unobtrusive to gameplay in order to advertise one or more companies or products. This is likely to be particularly effective in advertisement drinks or food in a bar or restaurant, but one of ordinary skill in the art will understand that there is no limitation to the type of advertisements able to be displayed. Another version of in-game advertising more deeply incorporates into the game, changing game objects or objectives in a way that corresponds to a brand being advertised. For example, instead of throwing generic game objects as targets, the target game objects may be transformed into ones specific to a brand identity.

In one embodiment, the play screen is configured for communication with at least one user device, such as a smartphone, tablet, or smart watch. This communication is useful for both players and owners of an establishment. For players, the user device is able to receive score information, see historical results for the player for particular games, and/or receive other information, such as sensor information from the urinal. For administrators, the games for each urinal and settings for those games (e.g., game volume) may be set with the user device, allowing for changes to the games or settings without needing to take apart the urinal. Alternatively, versions of the gaming urinal that do not communicate with user devices are also contemplated herein.

In one version, for those who wish not to play the game or not to hear sounds from the game, a button or other activator can be pressed to deactivate or mute the game. In an alternative paradigm, the game is off by default, and a user may use the activator to choose to turn on the play screen or to activate audio for the game. The button or activator may be located directly on the urinal, or adjacent to the urinal (e.g., on the wall).

The gaming urinal may also include incentives for flushing the urinal, to encourage a cleaner and more pleasant bathroom. This is particularly useful for versions of the urinal with a primarily manual flushing method, but even for automatic flushing systems, sensors are sometimes faulty and do not send a signal to flush. Therefore, one version of the gaming urinal prompts to flush at the end of the game in order for a score to be saved, or in order for a score to be sent to a user device, or some other such incentive. In order for this incentive mechanism to operate, especially in versions where the control electronics for the main urinal and the play screen are separate, after the urinal gets a signal (or manual operation to trigger a flush), a signal is passed to the communication unit of the play screen, noting that a flush event has been triggered.

The gaming urinal is not limited to a single play screen, and may include multiple screens either arranged adjacently horizontally, arranged vertically, or arranged without clear alignment vertically or horizontally. The inclusion of multiple play screens allows for multiple games to be played on a single urinal while still having each screen preprogrammed to a single game. In order to accommodate multiple screens, the size and dimensions of the gaming urinal may be changed, or the relative size of each screen may be decreased so as to fit. In embodiments with multiple play screens, each play screen may be accessible with a single back panel, or with a separate back panel for each screen.

In one embodiment, the urinal includes one or more light strips embedded into the back wall, the lower bowl, the rim, and/or an exterior surface. These light strips include a plurality of LEDs or other lighting elements, and each light strip may constantly emit light of the same color, provide flashing lights, and/or provide lights transitioning between different colors. A user device, such as that of an administrator, may be used to set the lighting color or color pattern, in order to meet a theme or décor element of the establishment or the bathroom in particular. In one embodiment, the control electronics for the lighting strips are in communication with the play screen, with the colors of the lighting strips dependent on what is being displayed on the display panel at any given time. For example, if a player gets a new high score, the lights may flash yellow. In another example, while playing a game with a woodland theme, the lights may be primarily green to match the colors of the game. The lights may also be synchronized with the music or sound effects of the game. For example, the lights may flash in sync with the beat of the music.

While the present invention is directed primarily toward entertainment purposes, with benefits of cleanliness, one or more sensors may also be used to provide analysis of urine collected by or flowing through the urinal, and/or to provide additional feedback for enhancing the gaming experience. For example, one or more volumetric flow sensors may be included proximate to or within the drain of the urinal, which are able to detect a flow rate of the urine. Flow rate data may be transmitted to and processed by a processor of the gaming urinal or a remote computer in order to determine total volume for a single urine stream. As urine streams are sometimes intermittent, rather than continuous, determination of what constitutes a single urine stream may be made by defining a threshold time interval after a urine stream stops where if it restarts during that time interval, it is considered to be part of the same stream. Additionally or alternatively, a flush of the gaming urinal or detection by an automatic flush system that a user is no longer present may be used to define the separation between urine streams.

The microcontroller for the play screen may receive flush signals from the automatic flush system or directly from one or more sensors (e.g., infrared sensors) used to control the automatic flush system. Flush signals may be used to determine when the game is reset, allowing for the end of the gaming session to easily be defined without specific feedback from the user, and also thereby allowing the game to be ready to play by the next player. Flush signals may also define a time interval (e.g., 5 seconds, 10 seconds, etc.) during which further feedback from the force detection layer is rejected and the play screen is rendered non-interactive for the time interval. This is useful for preventing water from the flush mechanism from affecting the play screen and either disrupting or affecting the previous play session or accidentally initiating a new play session. In versions of the urinal with different intensities of flush signal, the time interval may vary depending on the intensity of the flush signal (i.e., longer time intervals for higher intensity flush signals).

The gaming urinal may further include one or more temperature sensors, located within or near the drain to detect the temperature of an incoming urine stream, or located on a separate part of the gaming urinal (e.g., the back wall, an exterior surface, etc.). Additionally or alternatively, the gaming urinal may be in communication with at least one temperature sensor that is not attached to the gaming urinal and thereby able to receive sensor data from that external temperature sensor. Temperature sensor data may be used by the gaming urinal for a number of purposes, including for changing in-game aesthetics (e.g., low temperature readings cause a game to reskin with a winter theme) or for changing colors of lighting strips around the gaming urinal (e.g., low temperature readings cause colder colors to be used).

The gaming urinal may further include one or more analyte sensors proximate to or within the drain of the urinal, configured to detect for the presence or absence of one or more compounds, chemicals, molecules, or elements in the urine stream. Examples of analytes able to be detected by the one or more analyte sensors include, but are not limited to, glucose, bilirubin, one or more drugs or drug metabolites (e.g., tetrahydrocannabinol/THC-COOH, benzoylecgonine, amphetamine, methamphetamine, morphine, heroin, phenobarbital, butalbital, etc.), one or more alcohol metabolites (e.g., ethyl glucuronide), and creatinine. This allows the gaming urinal to serve a dual purpose as a health data collector or even to utilize live analyte detection to impact the function or appearance of the game being played. While the inclusion of health data collection is not the preferred embodiment for a bar, club, or other commercial setting where users do not consent to such collection, the use of a gaming urinal in a medical facility to collect consenting urine samples may be helpful for reducing anxiety of a patient during the collection process, especially for younger patients and patients with special needs. Importantly, embodiments of the present invention also exist which do not include any analyte sensors and do not collect any health data information.

The gaming urinal may include at least one specific gravity or osmolarity sensors proximate to or within the drain of the urinal. Specific gravity and osmolarity sensors allow the urinal to determine an approximate hydration level of the user. While this may be used as health information, similar to the analyte sensors described above, other versions of the gaming urinal may have sensor readings from specific gravity and osmolarity sensors only stored temporarily in a local memory long enough to determine if a user's hydration levels are below a specific threshold. If hydration levels are below the threshold, a message may appear on the play screen or be played via connected speakers reminding the user to hydrate, which is especially useful in a bar setting where poor hydration frequently leads to hangovers or other unfavorable outcomes. Furthermore, the hydration level may provide direct impact on the gameplay session (e.g., a power-up or point multiplier is provided in game if the hydration levels are above a threshold). Positive messages may also be displayed or played as an audio message if the user's hydration levels are above a preset threshold. Importantly, for non-health related settings, the data from such specific gravity or osmolarity sensors is preferably discarded after a short period of time (e.g., when the game session ends) and is not transmitted elsewhere, so as to not share health-related information of the user.

The gaming urinal may further include one or more pH sensors proximate to or within the drain of the urinal for detecting the pH of the urine.

In embodiments where the gaming urinal includes multiple different sensors or multiple different types of sensors, the gaming urinal may have each sensor positioned together in a single sensor bank, or have sensors distributed in different locations either proximate to the drain or within the drain.

One of ordinary skill in the art will understand that the "force detection layer" as described herein may only detect the location of an impact on part of the play screen and need not necessarily detect a degree of force applied. Therefore, the force detection layer may alternatively be considered an "impact detection layer." However, in another embodiment, the force detection layer detects both the location of the impact and the amount of force applied, allowing both parameters to be used as an input for a game or for otherwise controlling the screen.

The description and figures provided above are illustrative and are not to be construed as limiting. Numerous specific details are described to provide a thorough understanding of the disclosure. In certain instances, however, well-known or conventional details are not described in order to avoid obscuring the description. References to "one embodiment" or "an embodiment" in the present disclosure may be (but are not necessarily) references to the same embodiment, and such references mean at least one of the embodiments.

Reference in this specification to "one embodiment" or "an embodiment" means that a particular feature, structure, or characteristic described in connection with the embodiment is included in at least one embodiment of the disclosure. Multiple appearances of the phrase "in one embodiment" in various places in the specification are not necessarily all referring to the same embodiment, nor are separate or alternative embodiments mutually exclusive of other embodiments. The various described features may be exhibited by some embodiments and not by others. Similarly, the various described requirements may be requirements for some embodiments but not for others.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure.

Alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and is not intended to further limit the scope and meaning of the disclosure or of any exemplified term. Likewise, the disclosure is not limited to various embodiments given.

Unless otherwise defined, all technical and scientific terms used herein have the same meaning as commonly understood by one of ordinary skill in the art to which this disclosure pertains. In the case of conflict, the present document, including definitions, will control.

Aspects of the present invention may take the form of an entirely hardware embodiment or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium (including, but not limited to, non-transitory computer readable storage media). A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including object oriented and/or procedural programming languages. Programming languages may include, but are not limited to: Ruby®, JavaScript®, Java®, Python®, PHP, C, C++, C#, Objective-C®, Go®, Scala®, Swift®, Kotlin®, OCaml®, or the like. The program code may execute entirely on the user's computer, partly on the user's computer, as a stand-alone software package, partly on the user's computer, and partly on a remote computer or entirely on the remote computer or server. In the latter situation scenario, the remote computer may be connected to the user's computer through any type of network, including a local area network (LAN) or a wide area network (WAN), or the connection may be made to an external computer (for example, through the Internet using an Internet Service Provider).

Aspects of the present invention described herein refer to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions.

These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A gaming urinal, comprising:

a urinal body, including a back wall and a lower bowl, wherein the lower bowl includes a drain;

a play screen extending outwardly from the back wall of the urinal body, the play screen including:

a transparent cover;

a display panel; and a force detection layer;

wherein the force detection layer is configured to detect a location of force applied by a urine stream on the front of the play screen; and wherein the display panel interactively changes what is displayed based on where the force is detected by the force detection layer.

2. The gaming urinal of claim 1, wherein the gaming urinal is configured to communicate with at least one other gaming urinal, and wherein the communication enables the gaming urinal and the at least one other gaming urinal to facilitate a multiplayer, competitive game between users.

3. The gaming urinal of claim 2, wherein the communication is facilitated via an intermediary server.

4. The gaming urinal of claim 1, wherein the force detection layer includes a force-sensing resistor (FSR) matrix, one or more piezoelectric sensors, and/or one or more piezoresistive sensors.

5. The gaming urinal of claim 1, wherein the play screen is positioned at an upward angle relatively to the back wall of the urinal body.

6. The gaming urinal of claim 1, wherein the play screen further includes a transparent force distribution layer positioned between the transparent cover and the display panel.

7. The gaming urinal of claim 1, wherein the gaming urinal is configured to transmit and/or receive information from a user device.

8. A gaming urinal, comprising:

a urinal body, including a back wall and a lower bowl, wherein the lower bowl includes a drain;

a play screen extending outwardly from the back wall of the urinal body, the play screen including:

a display panel; and a force detection layer;

wherein the force detection layer is configured to detect a location of force applied by a urine stream on the front of the play screen;

wherein the display panel interactively changes what is displayed based on where the force is detected by the force detection layer; and wherein the gaming urinal is configured to communicate with at least one other gaming urinal, and wherein the communication enables the gaming urinal and the at least one other gaming urinal to facilitate a multiplayer, competitive game between users.

9. The gaming urinal of claim 8, wherein the communication is facilitated via an intermediary server.

10. The gaming urinal of claim 8, wherein the force detection layer includes a force-sensing resistor (FSR) matrix, one or more piezoelectric sensors, and/or one or more piezoresistive sensors.

11. The gaming urinal of claim 8, wherein the play screen is positioned at an upward angle relatively to the back wall of the urinal body.

12. The gaming urinal of claim 8, wherein the play screen further includes a transparent force distribution layer positioned adjacent to the display panel.

13. The gaming urinal of claim 8, wherein the gaming urinal is configured to transmit and/or receive information from a user device.

14. A gaming urinal, comprising:

a urinal body, including a back wall and a lower bowl, wherein the lower bowl includes a drain;

a play screen extending outwardly from the back wall of the urinal body, the play screen including:

a transparent cover;

a display panel;

a force detection layer, wherein the force detection layer includes a force-sensing resistor (FSR) matrix, one or more piezoelectric sensors, and/or one or more piezoresistive sensors; and at least one gasket providing a watertight seal;

wherein the force detection layer is configured to detect a location of force applied by a urine stream on the front of the play screen;

wherein the display panel interactively changes what is displayed based on where the force is detected by the force detection layer; and wherein the play screen is positioned at an upward angle relatively to the back wall of the urinal body.

15. The gaming urinal of claim 14, wherein the gaming urinal is configured to communicate with at least one other gaming urinal, and wherein the communication enables the gaming urinal and the at least one other gaming urinal to facilitate a multiplayer, competitive game between users.

16. The gaming urinal of claim 15, wherein the communication is facilitated via an intermediary server.

17. The gaming urinal of claim 14, wherein the play screen further includes a transparent force distribution layer positioned between the transparent cover and the display panel.

18. The gaming urinal of claim 14, wherein the gaming urinal is configured to transmit and/or receive information from a user device.

19. The gaming urinal of claim 14, wherein the gaming urinal includes an automatic flushing system, wherein the automatic flushing system transmits a signal to the play screen, and wherein the display panel changes what is displayed based on where the signal from the automatic flushing system.

20. The gaming urinal of claim 14, wherein the display panel is configured to display a shape tracing game.

* * * * *